US009616316B2

(12) United States Patent
Smith et al.

(10) Patent No.: US 9,616,316 B2
(45) Date of Patent: Apr. 11, 2017

(54) GOAL TENDER GLOVE

(71) Applicant: Warrior Sports, Inc., Warren, MI (US)

(72) Inventors: Peter B. Smith, Montreal (CA); Neal A. Watts, Montreal (CA); Eric D. Marvin, Lake Orion, MI (US)

(73) Assignee: Warrior Sports, Inc., Warren, MI (US)

( * ) Notice: Subject to any disclaimer, the term of this patent is extended or adjusted under 35 U.S.C. 154(b) by 489 days.

(21) Appl. No.: 14/177,975

(22) Filed: Feb. 11, 2014

(65) Prior Publication Data

US 2014/0259256 A1 Sep. 18, 2014

Related U.S. Application Data

(60) Provisional application No. 61/783,727, filed on Mar. 14, 2013.

(51) Int. Cl.
*A63B 71/14* (2006.01)
*A41D 13/08* (2006.01)
(Continued)

(52) U.S. Cl.
CPC ..... *A63B 71/143* (2013.01); *A41D 13/081* (2013.01); *A63B 2102/18* (2015.10);
(Continued)

(58) Field of Classification Search
CPC ... A63B 71/143; A63B 71/141; A63B 71/145; A63B 71/148; A63B 71/14;
(Continued)

(56) References Cited

U.S. PATENT DOCUMENTS 2,510,218 A 6/1950 Hugo
3,300,787 A * 1/1967 Denkert ..... A63B 71/143 2/19
(Continued)

FOREIGN PATENT DOCUMENTS

CA 1292594 12/1991
JP 2781754 B2 7/1998
(Continued)

OTHER PUBLICATIONS

Bauer Supreme One 100 Pro Goalie Glove (printed Mar. 4, 2013).
(Continued)

*Primary Examiner* — Amy Vanatta
(74) *Attorney, Agent, or Firm* — Warner Norcross and Judd, LLP

(57) ABSTRACT

A goaltender glove including a finger portion, a thumb portion and a webbed pocket extending therebetween to collectively form a catching area. The webbed pocket can include a rigid support element that extends into at least one of the finger portion and the thumb portion, and is connected to the same via an interface element. The support element pivots about the interface element, with a free end of the element pivoting away from or through a portion of the main shell to prevent excessive bending and stress on the element. The glove can include a selectively manually replaceable mitt, which can be replaced with another mitt, or removed for servicing the mitt or glove. The mitt can be attached to the main shell via an elastic member joined with the finger portion to enable fingers in the finger portion and the mitt to move together.

18 Claims, 14 Drawing Sheets

(51) Int. Cl.
*A63B 102/24* (2015.01)
*A63B 102/18* (2015.01)
*A63B 102/22* (2015.01)

(52) U.S. Cl.
CPC ..... *A63B 2102/22* (2015.10); *A63B 2102/24* (2015.10); *A63B 2209/10* (2013.01)

(58) Field of Classification Search
CPC ..... A63B 2102/24; A63B 2209/10; A63B 2102/22; A63B 2102/18; A41D 13/081; A41D 13/082; A41D 13/084; A41D 19/01523; A41D 19/015; A41D 19/01; A41D 19/0006
USPC ..... 2/16, 18, 19, 20, 161.1, 164
See application file for complete search history.

(56) References Cited

U.S. PATENT DOCUMENTS

| | | | | |
|---|---|---|---|---|
| 3,590,389 | A | 7/1971 | Latina | |
| 4,192,018 | A | 3/1980 | Latina | |
| 4,896,376 | A | 1/1990 | Miner | |
| 4,967,418 | A * | 11/1990 | Marcotte | A63B 71/143 2/16 |
| 5,349,705 | A * | 9/1994 | Ragan | A41D 19/01529 2/161.6 |
| 5,379,460 | A | 1/1995 | Aoki | |
| 5,435,008 | A | 7/1995 | Shane | |
| 5,511,244 | A | 4/1996 | Shikatani | |
| 5,551,083 | A * | 9/1996 | Goldsmith | A63B 71/143 2/161.1 |
| D385,667 | S | 10/1997 | Goldsmith | |
| 5,678,245 | A | 10/1997 | Rector | |
| D389,283 | S | 1/1998 | Goldsmith | |
| 5,781,929 | A | 7/1998 | Shikatani | |
| 5,787,506 | A | 8/1998 | Wilder et al. | |
| D435,700 | S | 12/2000 | Wilder et al. | |
| 6,182,289 | B1 | 2/2001 | Brown | |
| 6,256,792 | B1 | 7/2001 | MacDonald | |
| 6,571,394 | B1 | 6/2003 | Hackett | |
| D537,211 | S | 2/2007 | Contant et al. | |
| 7,480,943 | B2 * | 1/2009 | Schmadeka | A63B 71/143 2/161.1 |
| 9,072,325 | B2 * | 7/2015 | Ragan | A41D 19/0006 |
| 2003/0106131 | A1 * | 6/2003 | Tremblay | A63B 71/143 2/159 |
| 2004/0034899 | A1 | 2/2004 | Sullivano | |
| 2006/0206981 | A1 * | 9/2006 | Morrow | A63B 71/143 2/161.1 |
| 2006/0272068 | A1 | 12/2006 | Motooka | |
| 2011/0126342 | A1 * | 6/2011 | Bautista | A63B 71/143 2/161.1 |
| 2013/0036523 | A1 * | 2/2013 | Webster | A41D 19/01523 2/19 |
| 2014/0201880 | A1 * | 7/2014 | Binge | A63B 71/141 2/20 |
| 2014/0208478 | A1 * | 7/2014 | Salinas | A63B 71/143 2/19 |
| 2015/0089705 | A1 | 4/2015 | Ito | |
| 2016/0066633 | A1 * | 3/2016 | Greenacre | A41D 19/0006 2/161.1 |

FOREIGN PATENT DOCUMENTS

| | | | | |
|---|---|---|---|---|
| JP | 3195549 U | * | 1/2015 | A63B 71/143 |
| WO | 9417681 | | 8/1994 | |

OTHER PUBLICATIONS

Brians Sub-Zero Pro Goalie Glove (printed Mar. 4, 2013).
CoHo Revolution 588 RPM Pro Goalie Catch Glove (printed Mar. 4, 2013).
Reebok Larceny L7 Senior Goalie Glove (printed Mar. 4, 2013).
Sher-Wood T95 Senior Goalie Glove (printed Mar. 4, 2013).

* cited by examiner

GOAL TENDER GLOVE

BACKGROUND OF THE INVENTION

The present invention relates to sports equipment, and in particular to a goaltender glove.

A goaltender or goalie glove typically is used to catch a flying object and prevent it from entering a goal. In hockey, goaltender gloves usually are used to catch flying pucks or to smother a puck to the ice. The glove also is flexible enough to enable the goaltender to handle their hockey stick.

Typically, goaltender gloves are extremely stiff when they are new. A user has to spend hours of time of use to break-in the glove and make it flexible enough to their liking. One of the issues with regard to break-in is improving the flexibility of a "t-web," which is generally a portion of the glove located between a finger portion and a thumb portion of the glove. The t-web of a hockey goaltender glove typically includes a T-shaped member, with the upper portion of the "T" spanning between the thumb portion and the finger portion, and a vertical portion extending downwardly to intersect a location where the thumb meets the fingers. Webbing or lacing is interposed in the open areas between the T and the respective thumb portion and finger portion.

Most conventional t-webs have rigid to semi-rigid plastic or composite pieces that are located within a sleeve forming the upper portion of the T. These rigid pieces extend into the respective thumb portion and finger portion. The sleeve and rigid piece are laced in place and joined with a main shell of the glove. Typically, the t-web is laced tightly to the shell. When a glove is new, the shell near the rigid piece and the lacing is stiff and rigid. Typically, a user has to flex the finger portion toward the thumb portion hundreds, if not thousands, of times to loosen up the region between the rigid pieces and the respective thumb and finger portions. Many times however, due to the repeated closing and opening of the glove, the tip of the rigid piece that extends into the respective main shell bends at the lacing. Where it bends multiple times, it can significantly deform, and in some places crack or tear. When this occurs, the rigid piece in the t-web becomes structurally compromised which can be detrimental to the movement of the t-web and the performance of the glove in general. In addition, to address the lack of flexibility in the rigid pieces during the break-in period, many manufacturers skimp on padding in the palm, which can decrease protection for the wearer.

After break-in and continued use, goaltender gloves have other issues. For example, the interior of the glove can acquire a distinctive odor, and in some circumstances a crust from sweat can deposit on the interior of the glove.

Another issue with goaltender gloves is that the interior typically is constructed with a fixed angle of the thumb relative to the forefinger, which in turn provides a particular closure action. Some manufacturers make their gloves to allow the index finger to travel toward the tip of the thumb, while others make their gloves so that the tip of the index finger travels toward the base of the thumb. Accordingly, while a user may prefer a particular feature of one glove from one manufacturer, if that glove does not provide the desired closure action, the glove may not close to the user's liking, which can impair the user's goaltending capabilities.

SUMMARY OF THE INVENTION

A goaltender glove including a finger portion, a thumb portion and a webbed pocket extending there between to collectively form a catching area is provided. The goaltender glove can be a trapper or catching glove for use in catching game objects, for example, hockey pucks, balls or other elements.

In one embodiment, the webbed pocket includes a rigid support element that extends into at least one of the finger portion and the thumb portion. The support element can be constructed from carbon, composite, metal or some other rigid material. The element can be connected to finger portion and the thumb portion via respective interface elements.

In another embodiment, the rigid element is constructed so that pivots about the interface element, with an end of the element pivoting away from or through a portion of the main shell. Optionally, the main shell can define an opening sized slightly larger than the end to allow the free end to move through at least a portion of the opening. Where the finger portion and/or the thumb portion includes a reinforcement element at a distal end thereof, the end can pivot relative to, or generally move away from, at least a portion of the reinforcement element that it overlaps.

In still another embodiment, the support element and/or the end pivot so that the end moves away from an interior or catching area of the glove when the glove transitions from a closed mode to an open mode. Optionally, the end moves toward the interior or catching area when the glove transitions from an open mode to a closed mode.

In yet another embodiment, the support element can be covered with an elastic material that does not substantially hinder the pivoting of the end, but generally conceals or houses the end. The elastic member can extend across an opening or simply over the end, and can stretch or otherwise deform when the end moves.

In even another embodiment, the glove is equipped with a selectively replaceable mitt, which can be replaced with another mitt, or removed for servicing the mitt or glove. The mitt can be serviced by fixing it, washing it, cleaning it, or performing other operations on it that change or improve the operation of the mitt and/or the feel of the glove to the user.

In a further embodiment, the glove can include first and second selectively replaceable mitts, where the mitts each have different performance characteristics. For example, one mitt can include thumb and finger portions that are offset from one another at a first angle to provide a first type of closure or grip of the glove when closed. A second mitt can include thumb and finger portions that are offset from one another at a second, different angle, to provide a second type of closure or grip of the glove when closed. A user can select and install whichever mitt they desire based on desired performance characteristics and/or their physical stature.

In still a further embodiment, the mitt can be attached to a main shell or other component of the glove via an elastic member joined with the finger portion to enable fingers in the finger portion and the mitt in the finger portion to move together. The elastic member can further be releasably joined with the finger portion and/or the main shell so that the mitt is easily manually detached and removed from the glove for replacement or service.

The present invention provides a goaltender glove that is easy to break-in and able to accommodate a variety of different hand types and functional preferences. Where the glove includes the t-web rigid support elements with pivoting ends, it is quite flexible and can be broken in with minimal effort. Generally, the glove can be opened and closed with relative ease even when new. With such enhanced flexibility, more protective palm padding can be incorporated into the glove without sacrificing flexibility. Where the glove includes the removable and/or replaceable mitt or liner system, users can quickly and easily remove and service, wash or adjust the mitt and/or glove. The washing can alleviate typical odor and crust issues. Further, where a mitt has worn out, users can easily replace that mitt. Where the glove includes two or more replaceable mitts with different configurations or orientations, a user can swap one mitt for another depending on the user's desired performance characteristics or other physical attributes, in which case the glove provides a versatile, and customizable system.

These and other objects, advantages, and features of the invention will be more fully understood and appreciated by reference to the description of the current embodiment and the drawings.

Before the embodiments herein are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

A goaltender glove, also referred to as a goalie glove, in accordance with a current embodiment is illustrated in FIGS. 1-7 and 10-11 generally designated 10. While the drawings illustrate of a left-hand trapper or catching goalie glove, the current embodiment is well suited for right-hand trapper gloves, which generally are mirrored versions of the left-hand gloves. Additionally, the components and construction used in connection with the trapper glove can be readily modified to other types of gloves. Further, the glove as shown is designed for use in the game of hockey, however it can be used in a variety of other sports or activities, such as field hockey, baseball, or any activity where a user may use their hand in glove in the process of catching, trapping and/or blocking pucks, balls or other items.

Figure 1:
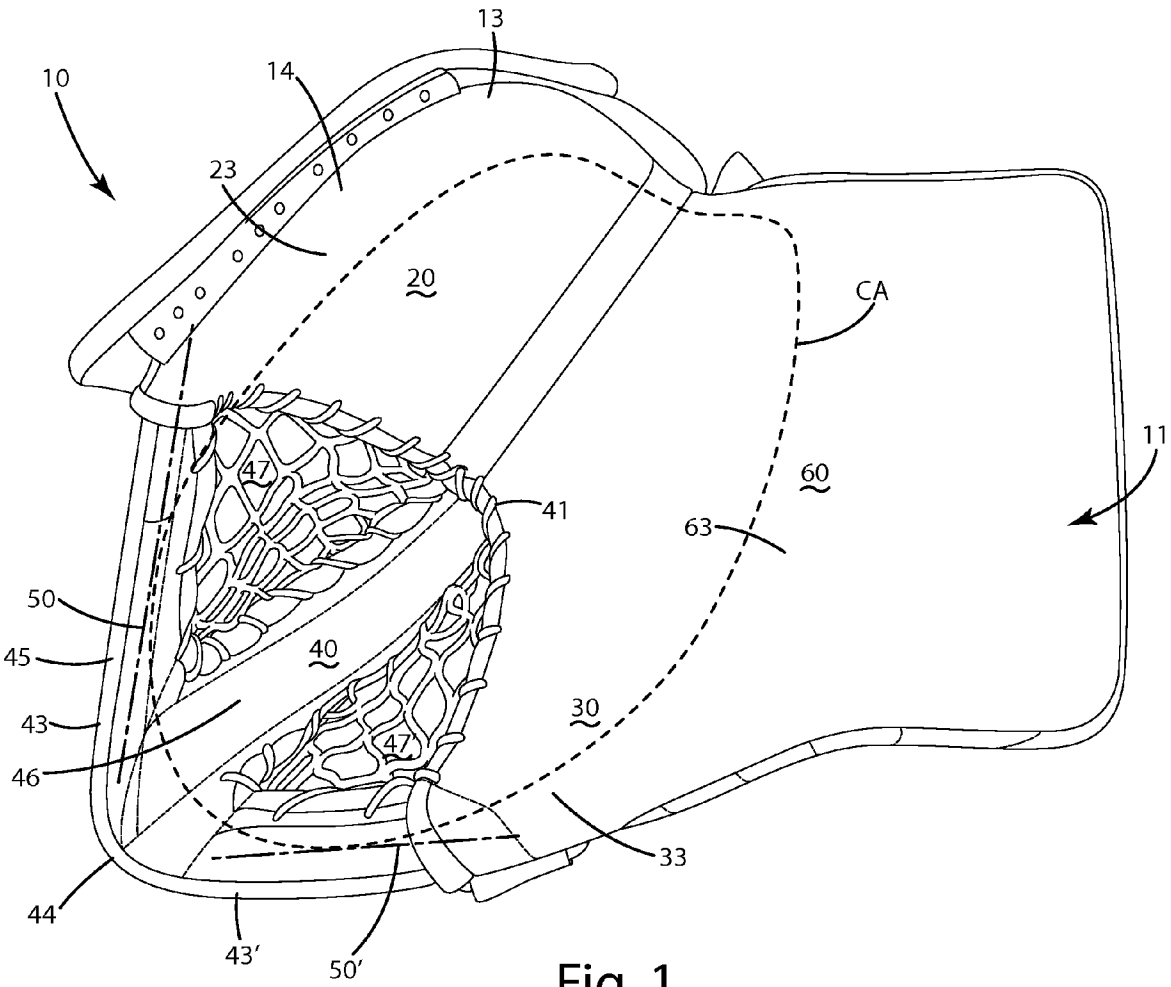
FIG. 1 is an interior or catching side view of the goal tender glove of a current embodiment, with the goal tender glove in an open mode.
Figure 2:
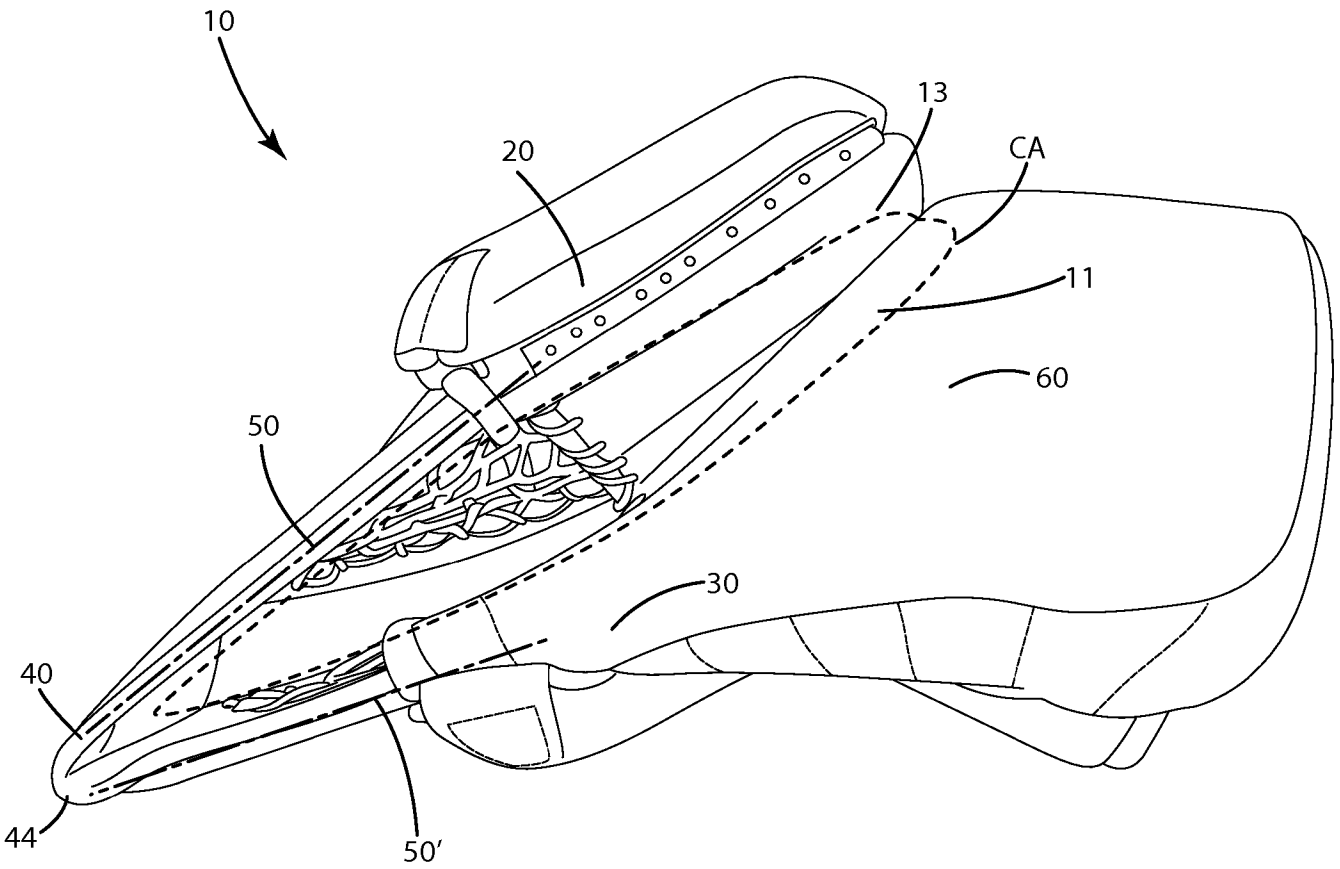
FIG. 2 is an interior or catching side view of the goal tender glove in a closed or catching mode.

As shown in FIG. 1, the glove 10 generally includes a catching area CA where a puck or other item is caught or captured. The catching area CA can extend over the finger portion 20, thumb portion 30, webbing pocket 40 (also referred to as a web) and/or the palm portion 60 of the glove. FIG. 1 illustrates the glove in an open mode with the catching area CA enlarged so that it can more easily capture or trap a puck. FIG. 2 illustrates the glove in the closed mode with the catching area greatly reduced in its exposed size. In the closed mode, with glove can be used to trap or hold a puck (not shown) therein.

The goalie glove 10 is constructed so that the finger portion 20 is joined with the palm portion 60, which is further joined with the thumb portion 30. These portions, for example, the finger portion 20, palm portion 60 and thumb portion 30 can be constructed from a main shell 13. The main shell 13 can include an interior 11 which generally faces toward the catching area CA and forms a surface that the puck or other items engage when being trapped or caught by the glove.

Figure 4:
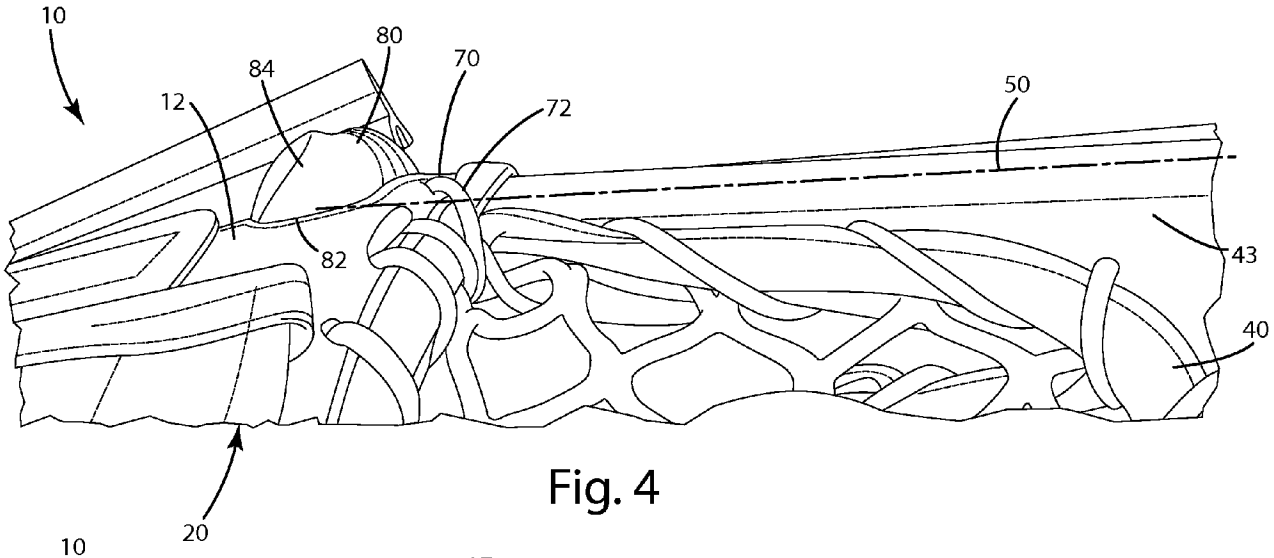
FIG. 4 is a close up view of a support element of a t-web with the glove in the closed mode.
Figure 5:
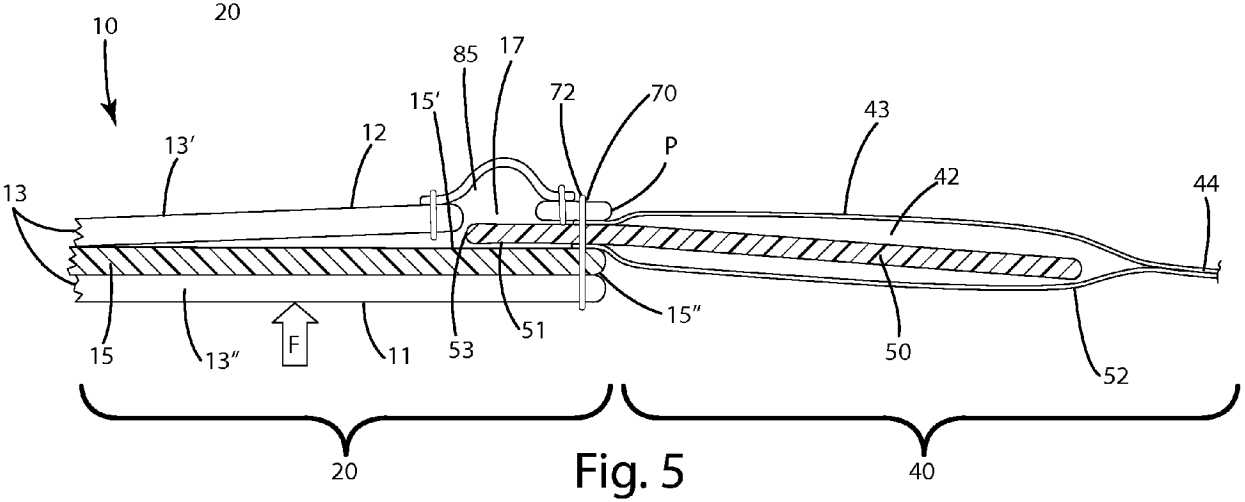
FIG. 5 is a section view of the support element of the t-web with the glove in the closed mode.

The main shell 13 also includes an exterior 12 which is better shown in FIGS. 4 and 5. The exterior 12 generally faces away from the interior 11, and is opposite the catching area CA on the glove 10. The main shell 13 can generally be divided up into different portions depending on location. For example, as shown in FIG. 1, the main shell can include a main shell finger portion 23 and a main shell thumb portion 33, as well as a main shell palm portion 63. All of these portions can be joined together to form a continuous main shell portion. The main shell and its components can generally be in the form of internal padding or other material that is wrapped, enveloped or otherwise disposed within an outer layer. The internal padding can be constructed from high-density foam, leather, densely packed material or other material that provides padding and protection to a wearer of the glove 10 when the catching area CA or interior 11 of the glove is impacted with a puck or other item. The outer layer can be constructed from a wear-resistant material such as leather, plastic, fabric, coatings or other materials.

The glove 10 also includes a web 40, which can be referred to as a web pocket or webbing herein. The web generally spans between the finger portion 20 and the thumb portion 30, connecting these portions to form a continuation of the catching area CA. The catching area CA generally overlaps the finger portion 20, the thumb portion 30 as well as the web 40. The web 40 can be a conventional single t-web. By that, it is meant that the web includes an upper portion 43, 43' which forms the upper portion of a "T." Another portion is connected to a central portion 44 and forms a central support 46 extending downwardly from the upper portion 43, 43' of the T. Collectively, the central support 46 and the upper portions 43, 43' form the "T" shape. Of course, other constructions may be used where multiple central supports 46 are used, forming double T, triple T or quadruple T webbed pockets.

Openings 47 and 47' can be formed adjacent the central support 46. These openings can be closed off or filled in with web-like material interlaced and crisscrossed as shown. Alternatively, the openings 47 and 47' can be completely closed off by a single piece of material extending from the central support 46 to the respective finger portion 20 and thumb portion 30.

Optionally, the central support 46 extends from the upper portion 43 and 43' downward to the bottom of the pocket near the intersection 41 of the thumb portion 30 and finger portion 20. There, it may be laced, fastened, or otherwise joined with the main shell in those regions. Where webbing or lacing is used to close the openings 47 and 47', the webbing can be laced to the respective finger portion 20 and thumb portion 30.

The web 40 shown in FIG. 1 includes a central portion 44. The central portion can form an inflection, bending or folding portion between the respective upper portions 43 and 43' of the web. The central portion 44 can correspond and connect to the uppermost portion of the central support 46. The respective upper portions 43 and 43' can include sleeves or tubes 42, 42' defining cavities, spaces or internal compartments. The sleeves can be formed by folding material or panels over one another and stitching along the edges of the panels. The material can be leather, plastic, fabric or combinations thereof. Within the sleeves or tubes, the support elements 50 and 50' are disposed.

In particular, as shown in FIGS. 1, 4 and 5, the upper portion 43 of the web can include a sleeve 42. Although referred to as a "sleeve," 42 this element of the upper portion 43 can include one or more openings, or can be singly attached to a forward, rearward, or some other surface of the support element 50. The sleeve 42 can be in the shape of an elongated cavity or a compartment.

The support element 50 can be disposed within the sleeve 42. Generally the sleeves and upper portions of the pocket as well as the rigid support elements on opposite sides of the central portion 44 and in connection are almost identical in structure and function. Therefore, only one side, in connection with the finger portion, will be described here. The side used in connection with the thumb portion will not be described here.

The support elements 50 and 50' each can be generally a rigid, hard structure that is designed to provide rigidity and structural integrity to the pocket, particularly the upper part of the pocket. The support element can be constructed from polymers, composites, metals and combinations thereof. Alternatively, any other material capable of maintaining the upper portions in a pre-desired configuration when the glove is opened and closed can be substituted for these materials.

As shown, the rigid support element 50 can be constructed in the form of a strip, bar or rod. This element is disposed within the sleeve 42, and in particular a cavity thereof. Of course, in certain constructions, where a sleeve or cavity for housing the element is not desired, the rigid support element 50 can be attached or fastened to the upper portion 43, and generally exposed on an exterior of the glove. As shown, however, the support element 50 is concealed and hidden within the sleeve. Optionally, the sleeve can completely circumferentiate, conceal and/or close off the support element disposed at least partially therein or attached thereto.

The upper portion 43 and the support element 50 are joined with the finger portion 20 so that the web pocket 40 and finger portion 20 are generally joined with one another. Although not shown in FIG. 5, the other upper portion 43' of the web 40 can be attached using a similar construction to the thumb portion 30.

Returning to FIGS. 4 and 5, the finger portion 20 can include a main shell 13 as described above. The main shell generally includes interior 11, facing toward and forming part of the catching area CA of the glove, and an exterior 12, facing outwardly or away from the catching area, generally on the back of the glove. Disposed between the main shell and different portions of the main shell 13' and 13", (FIG. 5) and generally in the upper portion 14 (FIG. 1) of the finger portion 20, a reinforcement element 15 can be disposed. Optionally, the reinforcement element can be constructed from the same material as the support member 50. The reinforcement element can be in the form of a strip, bar, or rod. It can extend across the entire upper portion 14 of the shell 13 within the finger portion and/or the thumb portion (not shown).

Referring to FIGS. 4 and 5, the support element 50 can be disposed at least partially within the sleeve and spans between the central portion 44 and the finger portion 20. The web 40 and/or support element 50 can be joined with the finger portion 20 and/or the thumb portion via an interface element 70. The interface element can be a construction where a lace 72 or other structure captures a portion of an end 51 of the support element 50.

Generally, the end 51 of the element 50 or a portion thereof can be trapped between portions of the main shell 13 and/or the portions of the main 13 and the reinforcement element 15. As illustrated in FIG. 5, the main shell exterior 13' is folded back and over itself, and in particular, the main shell interior 13". The interface element 70, including these parts, traps the end 51 of the support member 50. Optionally, the lace 72 of the interface element 70 can protrude through holes or otherwise pass through a portion of the end 51 of the support element 50. At this location, the end 51, and generally the rigid support element 50, can pivot relative to the interface element 70 about a pivot P as shown in FIG. 5. Optionally, the lace 72 of the interface element can be replaced with a fastener, wire, rivet, bar, pin, strap or some other structure to capture the end 51 at or around the pivot P. Further, although shown as a single pivot P, the pivot P can be a portion or area of the end 51 so that the end dynamically flexes or bends about multiple axes at the location near the pivot P, generally within or near the interface element 70.

The interface element 70 can be structured so that the end 51 can move toward and/or away from the interior 11 of the main shell, and generally toward or away from the exterior surface 15' of the reinforcement element 15. Optionally, the free end 51 can be joined with the main shell via the interface element 70 so that the outermost portion 53 of the free end 51 engages and disengages from the exterior surface 15' to the reinforcement element 15 but remains generally engaged with the end 15" of the reinforcement element 15. Further optionally, when pivoting about the pivot P, the rigid support element 50 can pivot relative to the end 15" of the reinforcement element 15. Indeed, the pivot P can correspond with and be adjacent the end 15".

Figure 7:
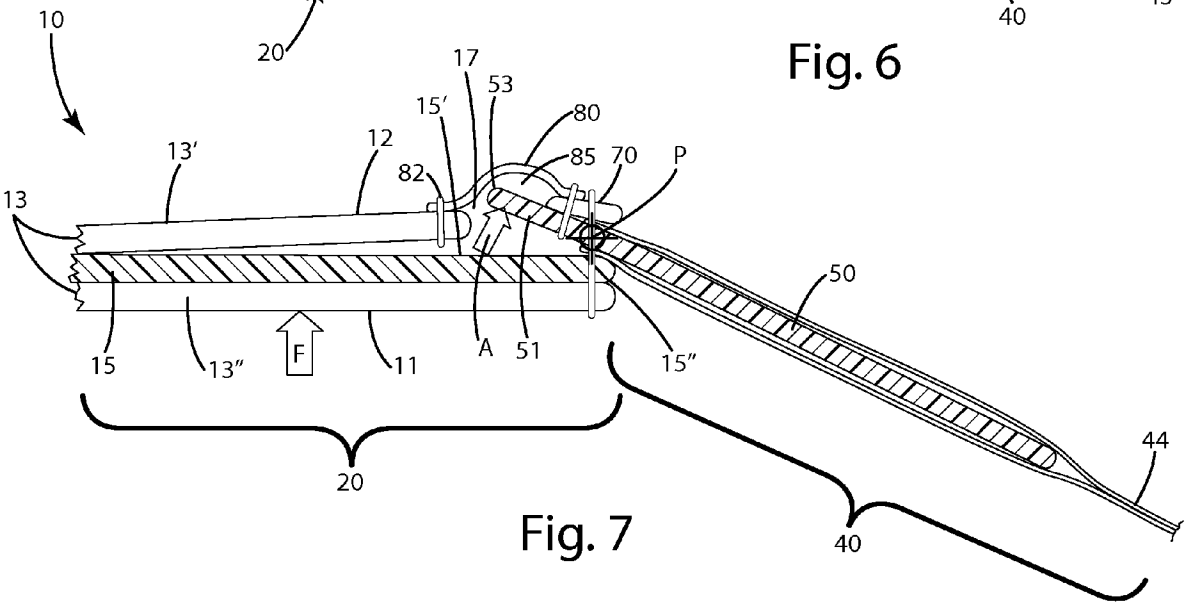
FIG. 7 is a section view of the support element and t-web with the glove in an open mode.

To facilitate the pivoting and general movement of the rigid support element 50, the outer part 13' of the main shell 13 can define an opening, aperture or slot 17. This opening 17 can be large enough so that the end 51 of the rigid support element 50 can pivot upward and at least partially through the opening 17 defined by the outer part of the main shell 13", as illustrated in FIG. 7. There, the glove has transitioned from the closed mode shown in FIG. 5 to the open mode of the glove shown in FIG. 7. In so doing, the finger portion 20 and web 40 have moved relative to one another. Further, the rigid support element 50 has pivoted about the pivot P and generally relative to the interface element 70. In so doing, the free end 51 of the support element has pivoted upward in the direction of the arrow A.

Generally, the end 51 moves away from the interior 11 of the main shell 13, and extends into the opening 17 and in some cases can pivot so that it protrudes out from the outer part 13'. Where the reinforcement element 15 is included in the construction, the outermost portion 53 of the end 51 disengages from the upper surface 15' of the reinforcement element and pivots relative to the end 15" of the reinforcement element. Generally, the end 51 is "free" to rotate and move away from and/or toward the reinforcement element 15 and the interior 11 of the main shell 13 and/or within the opening 17.

As the end 51 pivots or moves, the support member remains captured and restrained by the interface 70, which allows it to pivot. Optionally, the interface element 70 suspends, holds, and/or restrains the rigid support element 50 so that it is cantilevered, extending out over the reinforcement element 15 and/or generally into the main shell 13. The free end is cantilevered beyond the pivot P into the main shell 13 or generally adjacent the reinforcement element 15.

In some cases, the end 51 is allowed to pivot substantially about the interface element 70 and the respective pivot P so that the outermost portion 53 of the end protrudes beyond the outer part of the main shell 13. In this case, a compartment 80 can be joined with the main shell 13, for example the outer part of the main shell 13'. Compartment 80 can define a cavity 85 within which the end 51 can move. This cavity 85 can be contiguous with the opening 17. The end 51 can therefore move though the opening and into the cavity 85. The compartment 80 and cavity 85 can be of a variety of geometric shapes. For example, they can be generally triangular as shown, semicircular, domed, rounded, square, polygonal and/or pyramidal in shape.

The compartment 80 can be structured so that is accommodates the end 51 when the end protrudes through the opening 17 and into the compartment 80. The compartment 80 can be joined with the main shell 13, and in particular the outer part 13' of the main shell 13. The compartment 80 can include one or more walls 84 that are joined about a periphery 82 to the main shell. This may be accomplished by stitching, gluing, fastening or otherwise attaching the compartment walls to the main shell. Optionally, the main shell 13 can be modified or molded to include the compartment 80, contiguous with the opening 17 if desired.

Figure 6:
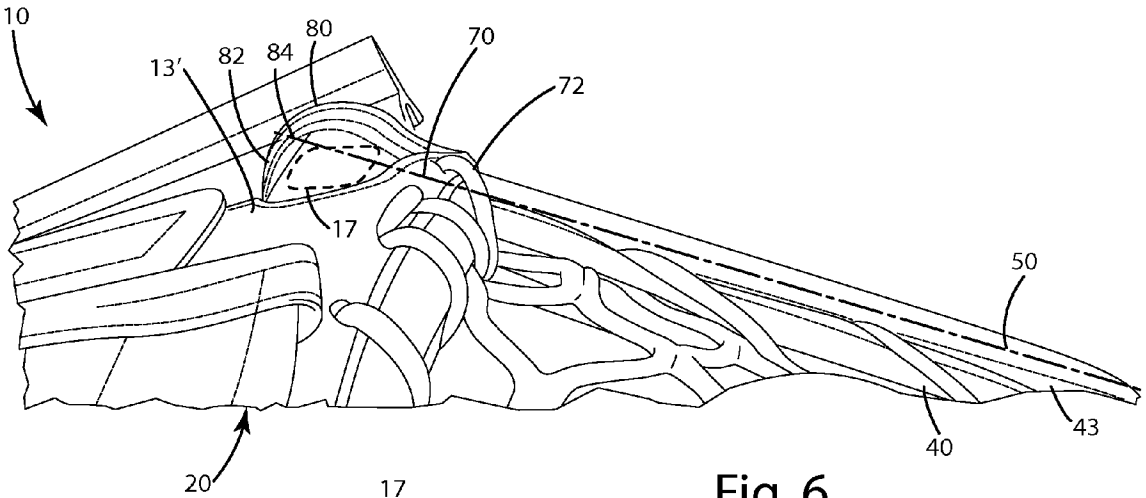
FIG. 6 is a close up view of the support element of the t-web with the glove in the open mode.
Figure 8:
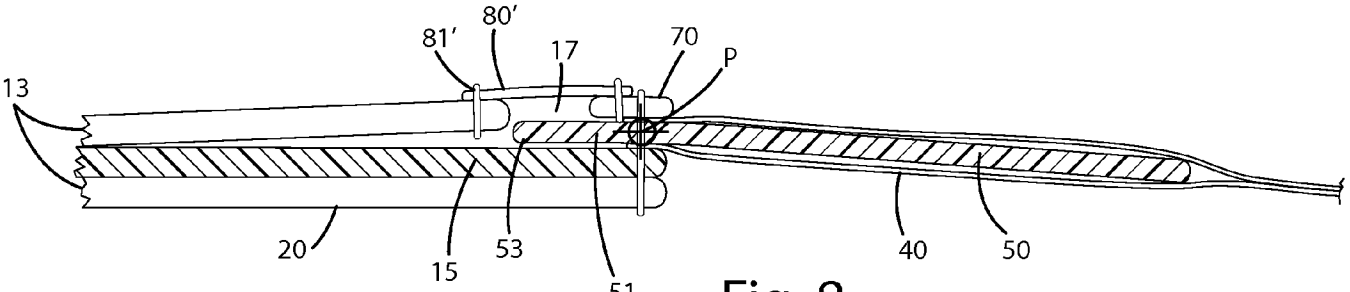
FIG. 8 is a section view of an alternative construction of the support element of the t-web with the glove in a closed mode.
Figure 9:
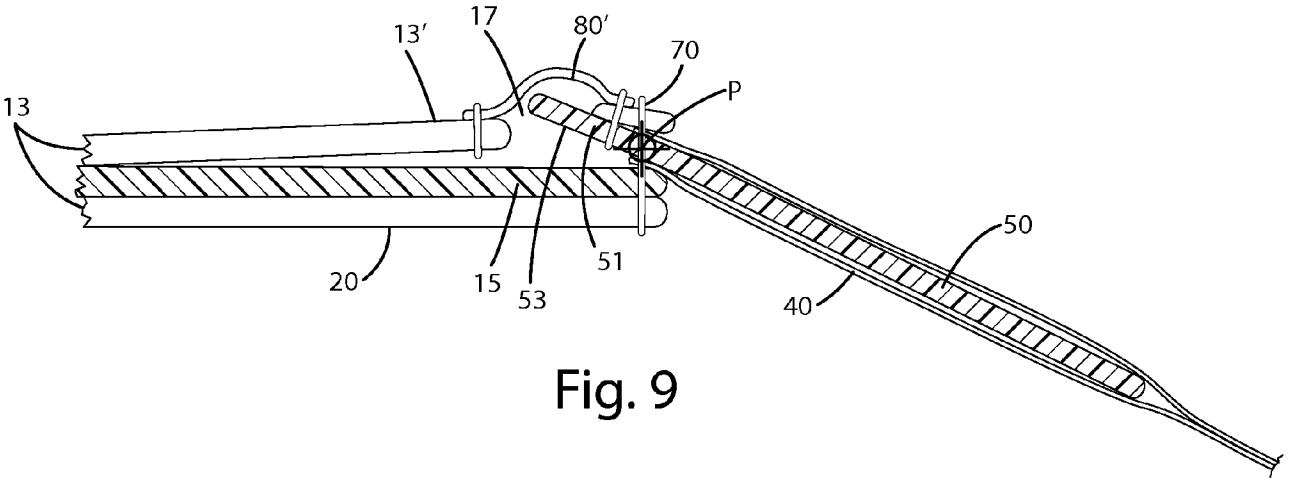
FIG. 9 is a section view of the alternative construction of the support element of the t-web with the glove in an open mode.

The compartment 80, which is shown as a three-dimensional element in FIGS. 6 and 7, can be replaced with a lower profile element as shown in FIGS. 8 and 9. For example, the compartment 80 can be replaced with an elastic member 80'. The elastic member can be constructed from a material such as Lycra®, polyester, spandex or some other stretchable fabric or material that is easily deformed and/or stretched when engaged by the end 51. The elastic member 80' operates so that when the glove moves from the closed mode shown in FIG. 8 to the open mode shown in FIG. 9, with the end 51 pivoting about the pivot P as shown in FIG. 9, the outermost portion 53 can move through the opening 17 until it engages the elastic member 80'. When it engages the elastic member 80', the end 51 pushes against it, causing it to stretch and/or deform. As is does, the elastic member 80' continues to cover the end 51, but also allows the end to continue its movement and pivoting about the pivot P.

When the glove transitions from the open mode shown in FIG. 9 to the closed mode shown in FIG. 8, the elastic member transitions back to the flattened and/or planar form shown in FIG. 8 all while keeping the end 51 covered and generally unexposed. Of course, in some circumstances where the opening 17 is small or hidden deep within the glove, a compartment 80 and/or elastic member 80' can be eliminated from the design altogether. In other constructions, the main shell can have a compartment formed directly in it so that it is contiguous with the opening and the end can move upward and into the end of the same.

The operation of the glove 10, and in particular the rigid support element 50 is such that the pocket 40 can be easily flexed and moved when the glove transitions from a closed mode to an open mode and vice versa. With the support element 50 joined with the finger and/or thumb portions via the interface element 70, the support element generally only pivots about the pivot P, rather than being bent or deformed at the location where the end 51 is joined with the shell 13. For example, in comparing FIGS. 5 and 7, the glove transitions from the closed mode shown in FIG. 5 to the open mode shown in FIG. 7 by the user applying a force F to the finger portion 20. This in turn pushes the finger portion 20 outward. The web 40, being joined with the thumb portion 30 (see FIG. 2) opens, with the central portion 44 being moved relative to the finger portion 20. As the glove transitions from the closed mode to the open mode, the support element 50 pivots so that the end 51 also pivots, moving away from the interior 11 of the main shell 13. The end 51 also pivots so that the outermost portion 53 of the end moves away from the optional reinforcing element 15 disposed within the main shell 13. The support element pivots about the pivot P of the interface element 70. The end 51 can transition through an opening 17 defined by the outer part 13' of the main shell 13'. As described above, where a compartment 80 or elastic member 80' is joined with the main shell 13, the end 51 can transition to fill or move into the compartment and/or stretch or deform the elastic material. Generally, the transition from the open mode as shown in FIG. 1 while the closed mode of the glove is shown in FIG. 2. When the user closes the glove 10 in a catching or trapping motion, the glove again transitions from the open mode to the closed mode, and the above process is reversed until the rigid support element 50 attains a configuration shown in FIG. 5.

As shown in FIGS. 10-17, the goaltender glove 10 of the current embodiment can be constructed to include a removable and replaceable mitt 110. With this construction, a user can remove the mitt 110 from the main shell 13 of the glove 10 and service the mitt or replace the mitt with another mitt. For example, the user can remove the mitt and wash it, deodorize it, repair it or modify it. Likewise, a user can replace a first mitt having a first configuration to provide first performance characteristics, with a second mitt having a second configuration to provide second performance characteristics as described further below.

Figure 3:
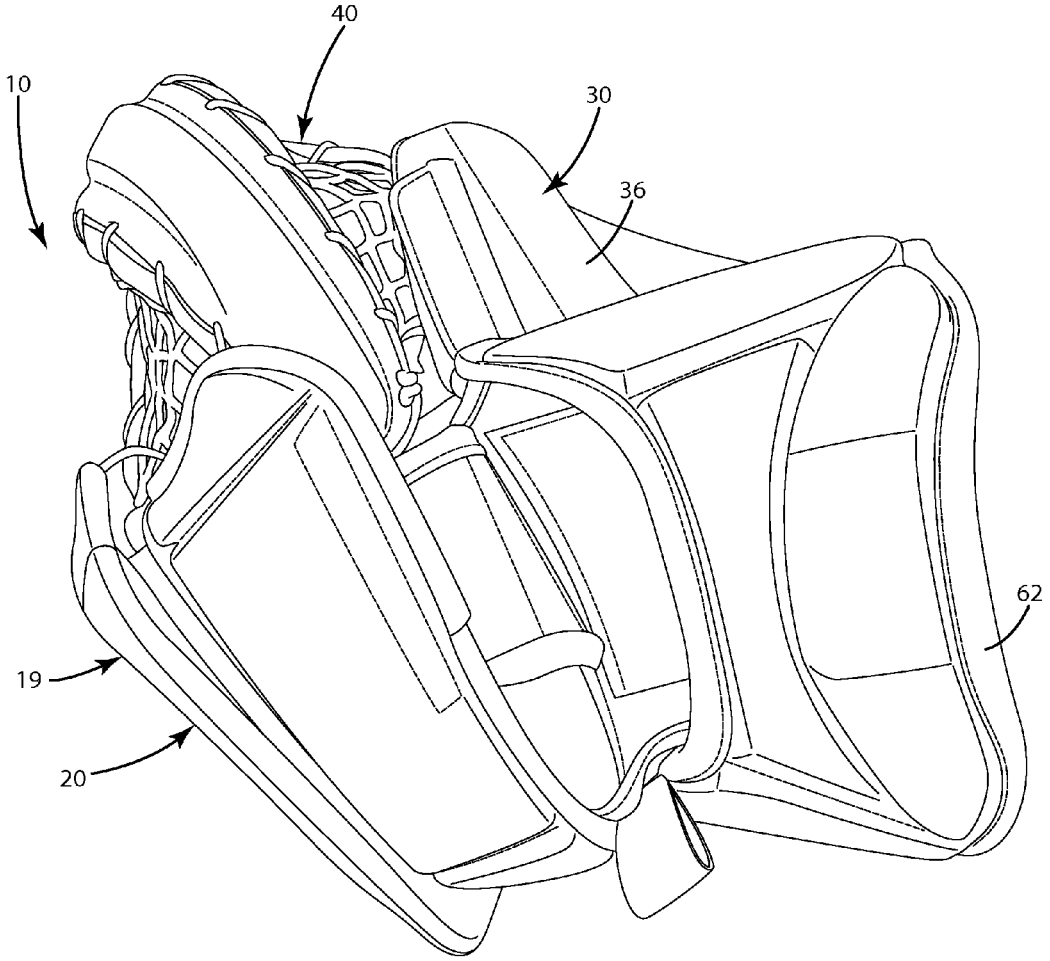
FIG. 3 is a rear view of the goal tender glove.

With reference to FIG. 3, the glove 10 can include a backhand 19. The backhand 19 can be constructed from one or more pads or paddings constructions. If desired, the padding can be wrapped in a liner or covering to protect the padding from excessive wear and tear. The backhand 19 is generally disposed opposite the main shell 13 shown in the other figures. The backhand 19 can be joined with the main shell in the finger portion and the thumb portion. The backhand can generally cover at least a portion of a mitt 110 when the mitt is installed in a mounted mode within the glove 10. The main shell 13 can be joined with the backhand 19 to form a cavity FC (FIG. 17) there between. Generally, the cavity FC is formed between the exterior 12 of the main shell and the interior 19' of the backhand 19. The mitt finger portion 120 can be disposed within the cavity FC.

The rear of the glove can also include multiple flaps that can assist in maintaining the user's hand within the glove, and/or precisely placing the hand and the mitt within the glove in a desired orientation relative to the catching area CA, the finger portion 20, thumb portion 30 and/or web 40. The straps and/or flaps joined with the main shell and extending over the mitt 110 can restrain and selectively position the mitt relative to the main shell 13 and glove 10. As an example, the glove can include a wrist cover flap 62 (FIG. 3). This wrist cover flap 62 can be joined with a portion of the main shell 13 via one or more fasteners and/or lace, or the wrist flap 62 can be joined via fasteners 62' and 62" shown in FIG. 10 so that the wrist flap 62 can be removeably secured in place over a user's wrist or portion of their forearm. FIG. 3 shows the wrist flap 62 in a closed configuration covering the wearer's wrist, whereas FIG. 10 shows the wrist flap 62 opened, exposing the mitt 110 for adjustment of the mitt and/or insertion of a user's hand within the mitt 110.

The glove 10 can also be constructed so that the thumb portion 30 includes a thumb flap 36 which is releasably attached and generally openable relative to a thumb compartment configured to receive a mitt thumb portion 130. The flap can be secured in place with releasable fasteners 37 and 37'. The fasteners 62, 62" and 37, 37' can be in the form of hook and loop fasteners, buttons, laces, or any fastener that is manually operable to detach the same from one another and release a flap or other component relative to the glove 10.

Figure 15:
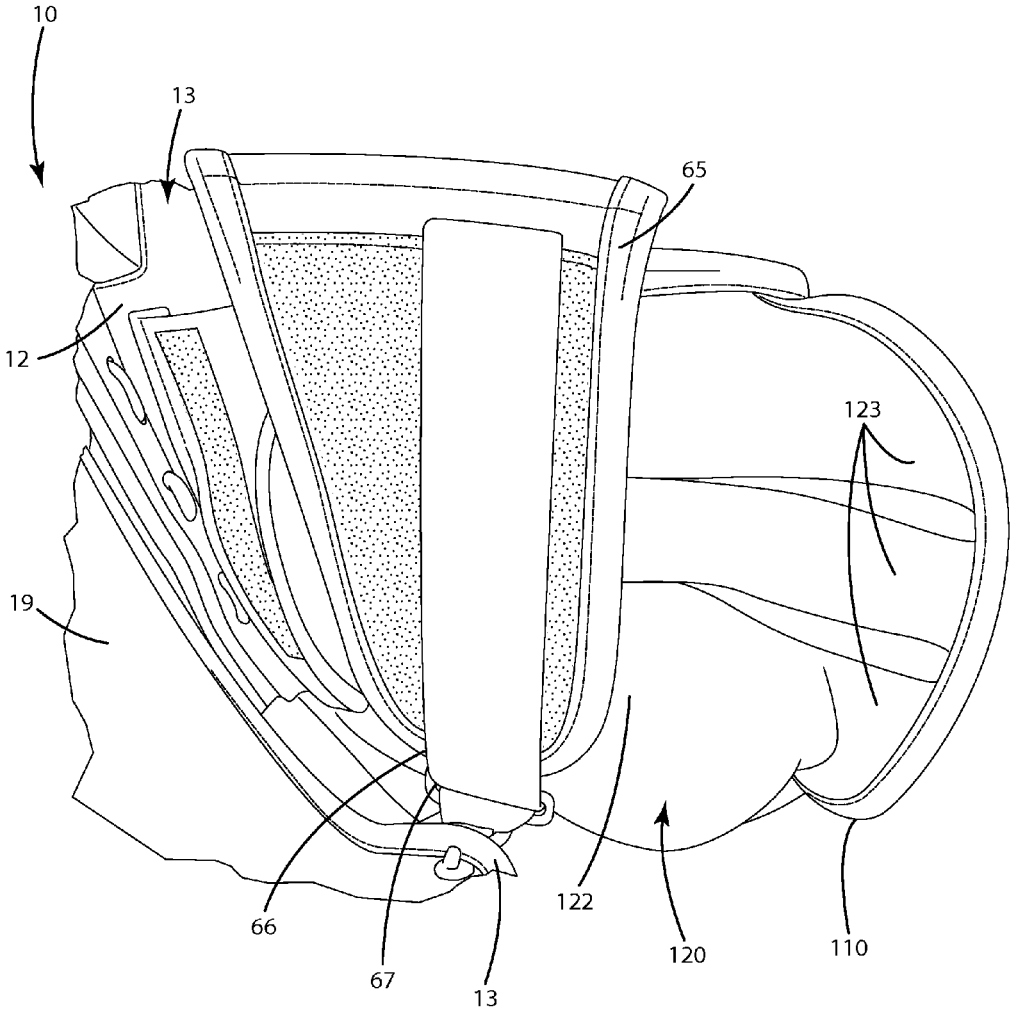
FIG. 15 is a rear or exterior view of the glove with the mitt disposed therein and a closure flap securing the mitt.

The glove can include a backhand capture flap 64. The backhand capture flap can extend over the rearward portion of the replaceable mitt 110. The backhand capture flap can be attached via system of fasteners, straps, and D-rings. Further as shown in FIG. 15, the glove can include a finger flap 65. This finger flap 65 can extend across the exterior 122 of the mitt finger portion 120. The finger flap 65 can be joined with fasteners as described herein to secure the mitt finger portion 120 to the main shell 13. Optionally, as shown in FIG. 15, the finger flap 65 can include a strap 66 having hook and loop fasteners associated with it. The strap 66 can be threaded through a D-ring 67 or other structure which is further joined to the main shell 13. The finger flap strap 66 can be doubled over on itself to secure the finger flap 65 in a fixed position over the replaceable mitt 120 as shown in FIG. 15.

Figure 10:
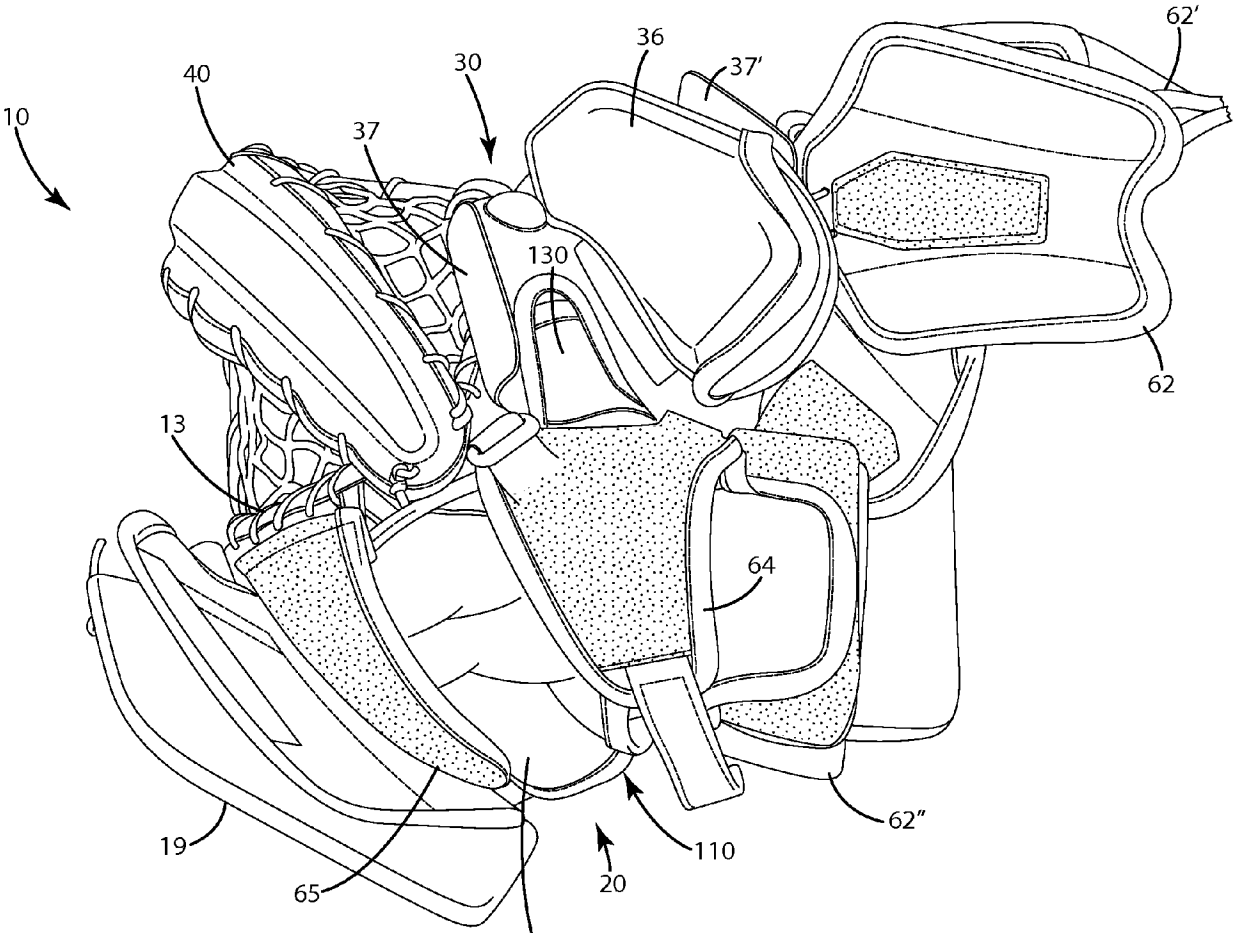
FIG. 10 is a rear view of the glove in an dissembled state illustrating a replaceable mitt installed in the glove.
Figure 11:
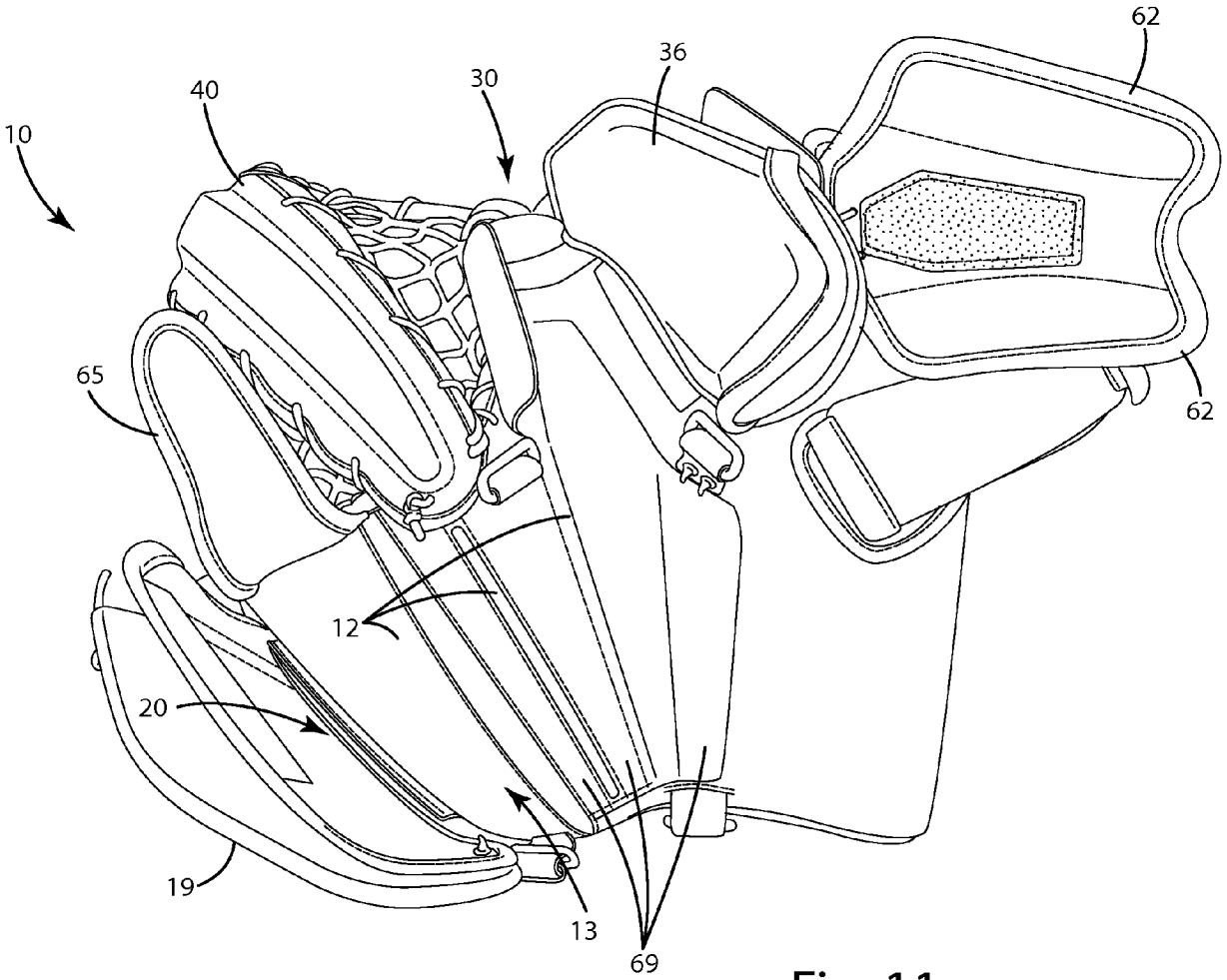
FIG. 11 is a rear view of the glove with the replaceable mitt removed from the glove.
Figure 12:
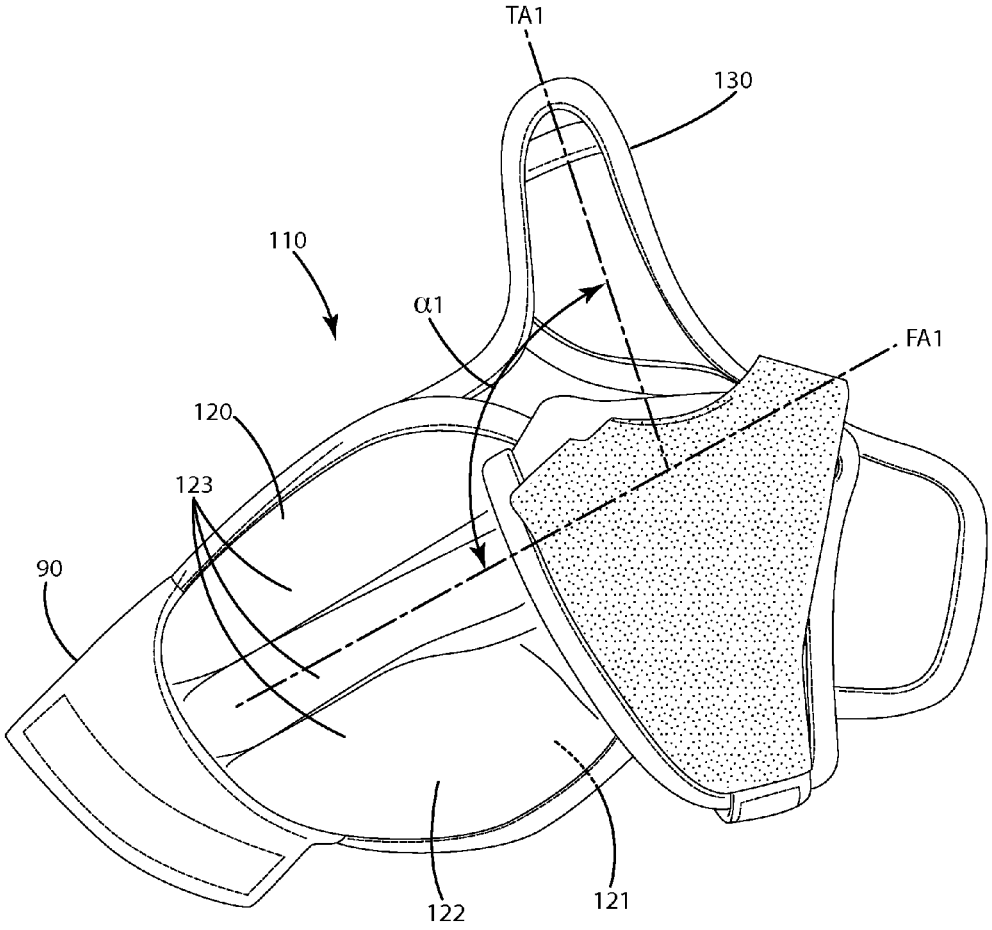
FIG. 12 is an exterior or top view of the replaceable mitt of the glove removed from the glove.

In comparing FIGS. 10 and 11, the glove in FIG. 10 is shown with the replaceable mitt manually detachably mounted within the glove with the finger flap 65, backhand flap 64, wrist flap 62 and thumb flap 36 securing the replaceable mitt within the glove and associated with the main shell 13. To remove the mitt 120 from the glove 10, the wrist flap 62, finger flap 65, backhand flap 64 and thumb flap 36 are loosened and "opened" to expose the mitt 120 as shown in FIG. 11. With all these flaps open, the mitt as shown in FIG. 12 can be removed from the glove 10. With the mitt removed, the glove generally does not include the mitt any longer, and the interior 12 of the main shell 13 is visible and empty as shown in FIG. 11.

Figure 13:
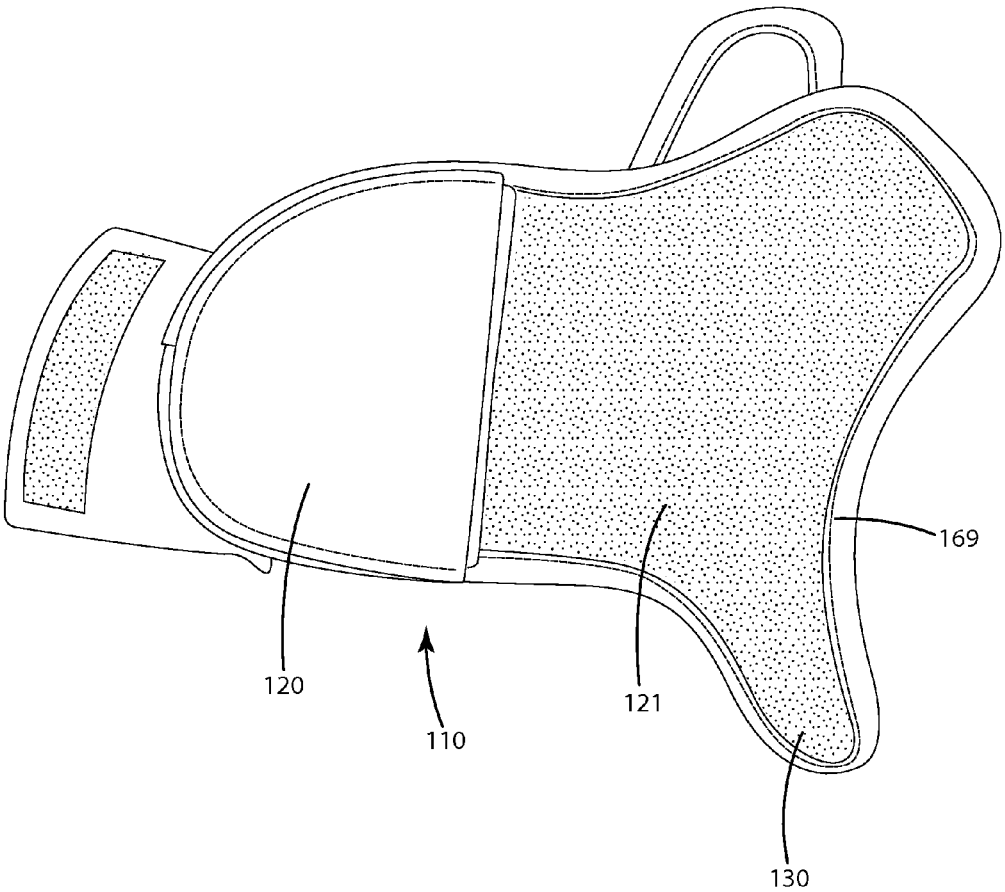
FIG. 13 is an interior or bottom view of the replaceable mitt with the mitt removed from the glove.

To replaceably mount and to detach the mitt 120 relative to the main shell 13, or generally to mount the mitt within the glove 10, the main shell 13 and interior 121 (FIG. 13) of the mitt can be outfitted with fasteners. For example, as shown in FIG. 11, hook and loop fasteners 69 can be disposed on the interior 12 of the glove opposite the palm portion 60 (FIG. 1) of the glove 10. The hook and loop fasteners 69 can join with corresponding hook and loop fasteners 169 disposed on the interior 121 of the mitt (FIG. 13). The fasteners can be particularly spaced and mounted on the mitt finger portion 120 and/or the mitt thumb portion 130. The main shell 13 can generally include a finger main shell that forms a portion of the exterior 12. The exterior can include the hook and loop fasteners. The mitt finger portion 120 can also include a corresponding hook and loop fasteners on the interior 121 of the mitt (FIG. 13). The mitt interior can be detachably joined to the finger main shell exterior via the interaction of the corresponding hook and loop fasteners of these elements. The thumb portion 30 also can include hook and loop fasteners on the exterior surfaces 12 thereof. The mitt thumb portion 130 can include corresponding hook and loop fasteners on it. The mitt interior and in particular the thumb portion of the mitt can be detachably joined to the thumb main shell exterior via the interaction of the hook and loop fasteners of the respective components. Optionally, for mounting of the replaceable mitt to the glove, other fasteners such as buttons, laces, loops, series of D-rings and other constructions can be used as desired.

Generally, the fasteners are constructed so that a user can manually remove the mitt 110 from the cavity FC and/or the main shell 13 without destroying the mitt and/or the main shell. In turn, the user can either replace the mitt with another mitt and/or service the mitt.

As shown in FIG. 12, the mitt 110 can include a mitt finger portion 120 and a mitt thumb portion 130. The mitt 110 can further define a plurality of finger stalls 123 within which a user's fingers can be selectively and independently positioned. Although shown as a mitt with the finger portions joined with one another, as used herein, a mitt can also include a glove-like structure with finger ports or stalls that are independently moveable and physically separated from to one another.

As shown in FIG. 12, the replaceable mitt 110 can include an exterior 122 which is generally opposite the interior 121 of the mitt. Generally, the interior 121 of the mitt faces and is placed directly adjacent the exterior 12 of the main shell 13. The exterior 122 of the mitt faces outwardly away from the exterior 12 of the main shell 13.

The mitt can include a particular orientation of the thumb portion 130 relative to the finger portion 120. For example, as shown in FIG. 12, the thumb portion can define a thumb axis TA1. The finger portion 120 can define a finger axis FA1. The finger axis FA1 can be disposed at a preselected angle $\alpha$1 relative to the thumb axis TA1. This angle $\alpha$1 can be selected so that the thumb moves toward the fingers, or generally the thumb portion moves toward the finger portion, in a particular configuration and path. The angle $\alpha$1 can range optionally from about 75° to about 130°, further optionally about 90° to about 120°, and even further optionally about 100° to about 110°. The angle α1, as well as the configuration of the stalls and their angles relative to the finger access FA1, can be customized depending on the desired performance characteristics of the glove.

Optionally, the finger stalls 123 are offset from the first mitt thumb axis TA1 at the preselected angle α1.

Figure 14:
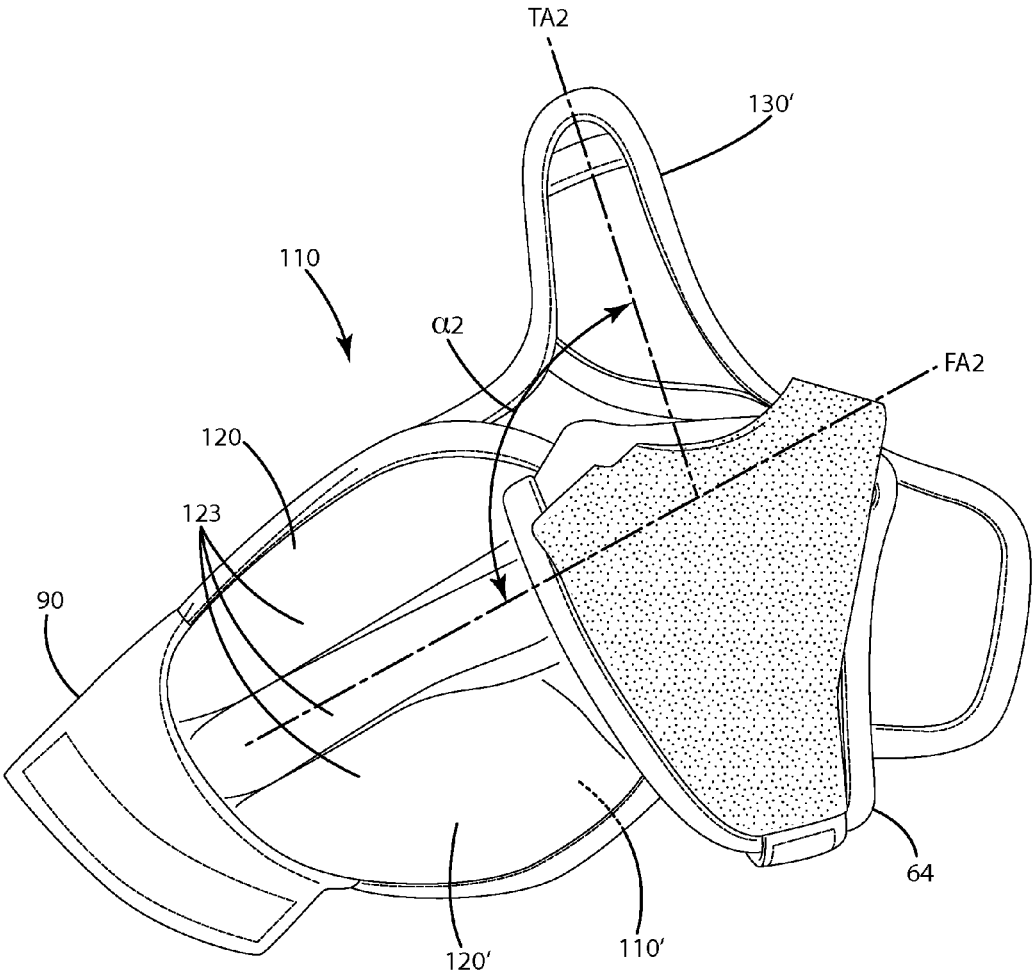
FIG. 14 is a top or exterior view of an alternative or second mitt for use with the glove.

The glove 10 can be constructed to receive different replaceable mitts having different configurations. For example, as shown in FIG. 14, a second replaceable mitt 110', similar to the first mitt 110 described with reference to FIG. 12, can be provided with the glove 10. This second mitt 110' can include a second mitt finger portion 120' and second mitt thumb portion 130'. The second mitt finger portion 120' can define a finger axis FA2. The second mitt thumb portion 130' can define a second thumb axis TA2. The second thumb axis and the second finger axis TA2 respectively can be offset at a second preselected angle α2. The second angle α2 can be different, that is, greater than, or less than the first angle α1 described in connection with the first mitt 110 shown in FIG. 12. Generally, the second angle α2 can provide different feel and performance of the second mitt, and thus the glove 10 when the second mitt is installed. For example, when installed in a glove, upon transitioning the glove to a closed mode, the second mitt and the second angle α2 can provide a different feel relative to feel provided by the first mitt and the first angle α1.

The glove can be provided with two or more different mitts having different angles or generally being configured with stalls offset at different angles relative to one another. The different mitts can be of different sizes, interior textures, stiffnesses and the like as well. Accordingly, a user can select the mitt of their choice depending on the desired performance characteristics and/or feel. Because the mitt constructions are replaceable and manually removable from the glove, the user can swap different mitts, depending on the particular desired function. Further optionally, mitts can be offered with a glove in sets. One of the mitts in the set can include minimal padding on the interior facing the interior or catching area of the glove. This mitt can be used for regular game play. A second mitt with substantially more padding on the interior facing the interior or catching area can be offered in the set. This mitt can be installed and used with the glove during practice to protect the user's hand during multiple repeated shots, and decrease the incidence of stingers or hand injury during practice.

Figure 16:
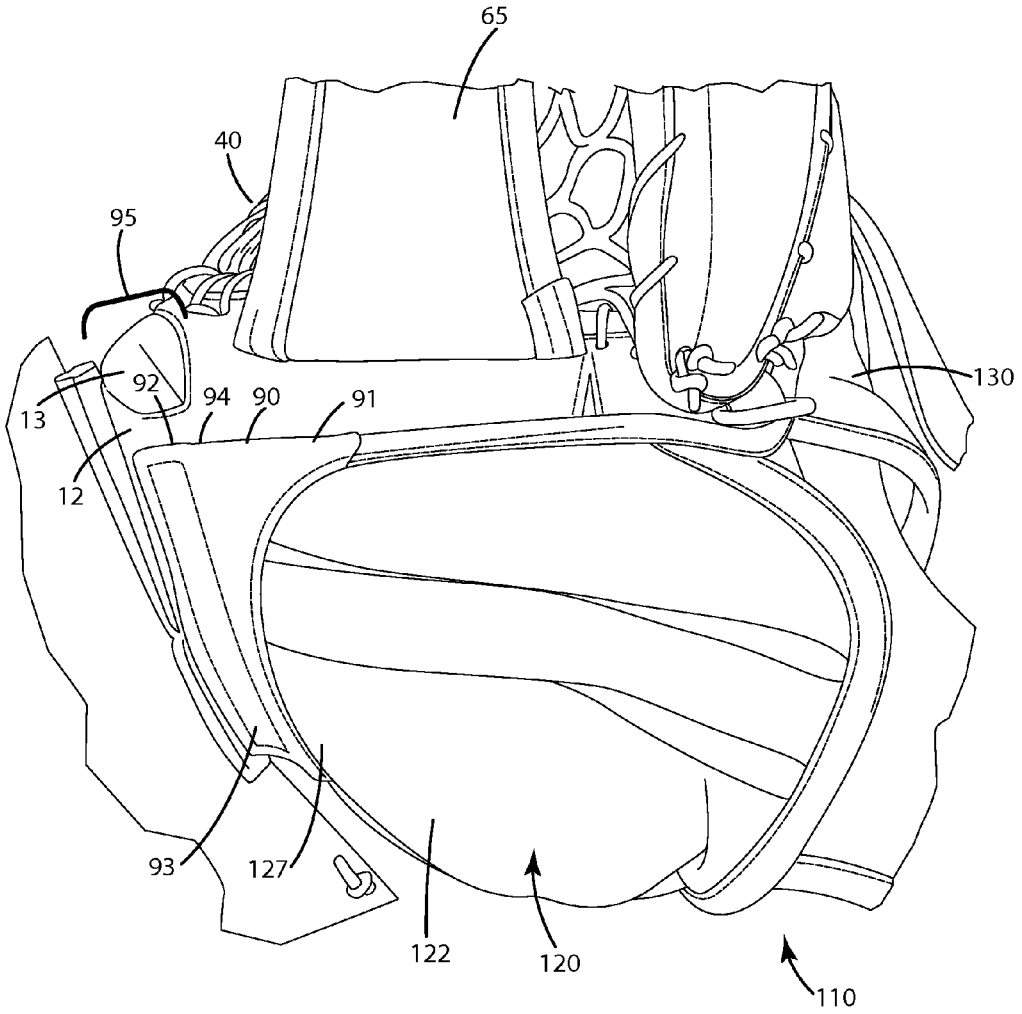
FIG. 16 is a rear or exterior view of the mitt further illustrating an elastic member joining a finger portion of the mitt to the main shell of the glove.
Figure 17:
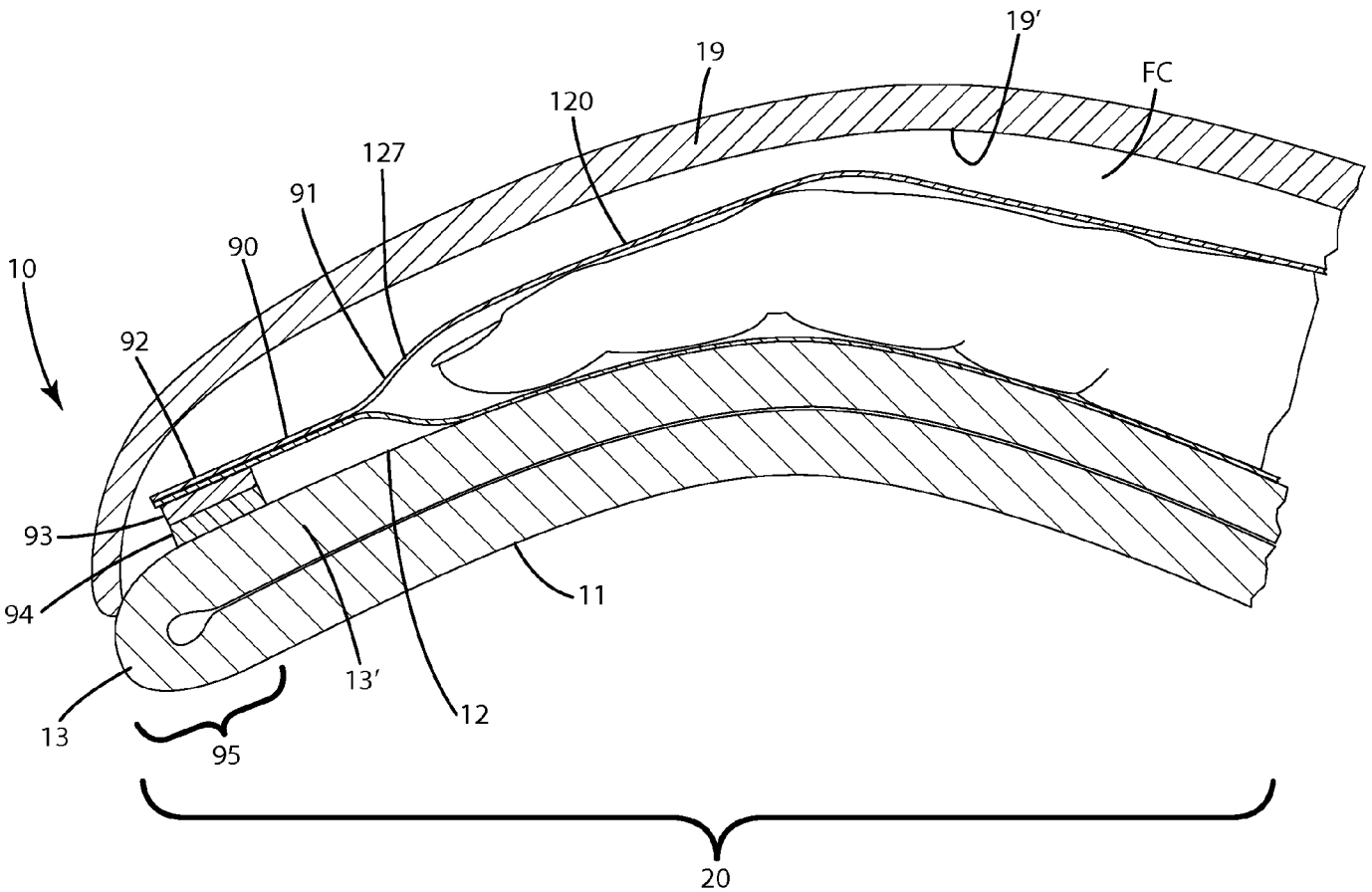
FIG. 17 is a section view of the glove illustrating the mitt elastically coupled to the main sell to maintain the finger portion of the mitt in a desired configuration.

As shown in FIGS. 12, 16 and 17, the glove can be outfitted with a construction to enable a user's fingers to move without substantial slipping relative to the mitt and the main shell as the glove transitions from a closed mode to an open mode and vice versa. For example, the mitt 110, which may or may not be detachable and replaceable with this construction, can include an elastic member 90. The elastic member 90 can be constructed from Lycra®, spandex, nylon, rubber, a polymeric material or the like. Generally, the elastic member has some amount of elasticity in it which allows it to stretch or deform relative to an original configuration, and then return to its original configuration. The elastic member includes a first end 91 and a second end 92. The first end 91 is joined with the mitt finger portion 120, optionally at the distal end 127 of the mitt finger portion. The elastic member extends to the second end 92. The elastic member 90 extends to and is joined with the main shell 13 and in particular the exterior 12 of the main shell 13 as shown in FIG. 17. Optionally, that second end 92 can be detachably joined with the main shell 13 via a hook and loop fastener. For example, the second end 92 can include a first hook and loop fastener 93. This hook and loop fastener 93 can be joined with a corresponding second hook and loop fastener 94 to join the elastic member 90, and therefore secure the mitt finger portion 120 to the shell end portion 95.

Although shown as being attached to distal end 127 of the finger portion 120, the elastic member 90 can be joined at different areas of the mitt finger portion 120. For example, it can be joined farther toward the wrist. Alternatively, a long strip of the elastic member can extend over and be attached at multiple points and locations along the exterior surface 122 of the mitt finger portion 120. Further, although not shown, a similar elastic member can be joined with the end of the mitt thumb portion 130 and secured to a tip of the main shell in the thumb portion 30.

As shown in FIG. 17, the elastic member 90 can operate to generally pull the distal end 127 of the finger portion 120 toward the shell end portion 95. If desired, tension can be applied through and by the elastic member 90 so that the mitt finger portion 120 is somewhat taut within the cavity FC defined between the main shell 13 and the backhand 19. With the elastic member 90 joining the finger portion 120 to main shell, excessive bunching and/or uneven stretching of the finger portion 120 can be avoided as the user opens and closes the glove 10. In some cases, the elastic member 90 can selectively pull the distal end 127 of the finger portion 120 toward the shell end portion 95. Fingers disposed in the glove or the mitt can move together, within the first mitt without the fingers slipping substantially relative to the interior of the first mitt as the glove transitions from a closed mode to an open mode and vice versa. Of course, the elastic member 90 need not always operate to pull or provide tension to the distal end 127 of the mitt finger portion 120. For example, the elastic member 90 can be constructed from a non-elastic material so as to simply secure the distal end 127 in a generally fixed orientation relative to the shell end portion 95.

All patents, patent applications, and literature references cited in this specification are hereby incorporated herein by reference in their entirety. In case of conflict, the present description, including definitions, will control.

Directional terms, such as "vertical," "horizontal," "top," "bottom," "upper," "lower," "inner," "interior," "exterior" "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A goaltender glove comprising:

a shell finger portion including a finger main shell, a shell end portion, and padding facing a catching area;

a shell thumb portion including a thumb main shell and padding facing the catching area;

a webbed pocket extending between the shell finger portion and the shell thumb portion, the webbed pocket contiguous with the catching area;

a replaceable mitt including a mitt finger portion defining a plurality of finger stalls and a mitt thumb portion defining a thumb stall so that a user's hand can be placed within the replaceable mitt, with a plurality of the user's fingers located in the plurality of finger stalls and with the user's thumb located in the thumb stall, the mitt thumb portion joined with the mitt finger portion so that a distal end of the mitt finger portion is moveable toward the mitt thumb portion;

wherein the replaceable mitt is operable in an installed mode, in which the mitt finger portion is adjacent and detachably joined with the shell finger portion, and in which the mitt thumb portion is adjacent and detachably joined with the shell thumb portion, with the mitt finger portion and the mitt thumb portion being disposed on opposite sides of the webbed pocket, wherein the replaceable mitt is alternatively operable in a removed mode, in which the mitt finger portion and the mitt thumb portion are removed entirely from the shell finger portion and the shell thumb portion, and dissociated from the glove, wherein the mitt finger portion is elastically coupled to the shell finger portion so that the mitt finger portion is selectively urged toward the shell end portion.

2. The goaltender glove of claim 1 wherein the replaceable mitt is structured so that the mitt finger portion and mitt thumb portion are oriented at a first angle relative to one another.

3. The goaltender glove of claim 2, comprising another replaceable mitt including another mitt finger portion and another mitt thumb portion oriented at a second angle relative to one another, wherein the replaceable mitt and the other replaceable mitt are selectively interchangeable with one another, whereby a user can select and install either the replaceable mitt or the other replaceable mitt depending on the user's preference of the first angle or the second angle.

4. The goaltender glove of claim 1 comprising a backhand joined with the finger main shell and the thumb main shell, the backhand generally covering at least a portion of the replaceable mitt when the replaceable mitt is in the installed mode.

5. A goaltender glove comprising:

a main shell including a shell finger portion and a shell thumb portion joined with a webbed pocket spanning there between, the shell finger portion including a shell end portion, the main shell including an interior defining a catching area that extends into the webbed pocket, the shell finger portion and the shell thumb portion, the main shell joined with a backhand to form a cavity between an exterior of the main shell and an interior of the backhand;

a first mitt including a first mitt finger portion and a first mitt thumb portion, the first mitt disposed in the cavity, the first mitt including a distal end and defining a mitt interior;

a member including a first end and a second end, the first end of the member joined with the first mitt finger portion adjacent the distal end, the second end of the member joined with the shell end portion, wherein the member joins the distal end of the first mitt finger portion and the shell end portion, whereby the first mitt and a plurality of fingers disposed in the first mitt move together without the fingers slipping substantially relative to the interior of the first mitt as the glove transitions from a closed mode to an open mode, wherein the member is an elastic member, and the second end of the member includes a fastener, wherein the shell end portion includes a corresponding fastener that is selectively manually attachable and detachable from the fastener.

6. The goaltender glove of claim 5 comprising a plurality of straps joined with the main shell and extending over the first mitt to restrain and selectively position the first mitt relative to the main shell, and a flap extending over at least a portion of the first mitt between the mitt and the interior of the backhand.

7. A goaltender glove comprising:

a shell finger portion including a finger main shell, a shell end portion, and padding facing a catching area;

a shell thumb portion including a thumb main shell and padding facing the catching area;

a webbed pocket extending between the shell finger portion and the shell thumb portion, the webbed pocket contiguous with the catching area;

a replaceable mitt including a mitt finger portion defining a plurality of finger stalls and a mitt thumb portion defining a thumb stall so that a user's hand can be placed within the replaceable mitt, with a plurality of the user's fingers located in the plurality of finger stalls and with the user's thumb located in the thumb stall, the mitt thumb portion joined with the mitt finger portion so that a distal end of the mitt finger portion is moveable toward the mitt thumb portion;

wherein the replaceable mitt is operable in an installed mode, in which the mitt finger portion is adjacent and detachably joined with the shell finger portion, and in which the mitt thumb portion is adjacent and detachably joined with the shell thumb portion, with the mitt finger portion and the mitt thumb portion being disposed on opposite sides of the webbed pocket, wherein the replaceable mitt is alternatively operable in a removed mode, in which the mitt finger portion and the mitt thumb portion are removed entirely from the shell finger portion and the shell thumb portion, and dissociated from the glove, wherein an elastic member is joined with the shell finger portion, wherein the mitt finger portion includes a distal end adapted to locate adjacent fingertips of a plurality of fingers, wherein the elastic member is joined with the mitt finger portion and adapted to urge the distal end toward the shell end portion, whereby the mitt finger portion is generally held in an unbunched configuration so that the plurality of fingers within the mitt finger portion can move smoothly against an interior of the mitt.

8. The goaltender glove of claim 7 wherein the elastic member is removably joined with the shell end portion of the shell finger portion so that the elastic member can be detached from the shell end portion and enable the mitt finger portion to be removed from the shell finger portion.

9. A goaltender glove comprising:

a shell finger portion including a finger main shell, a shell end portion, and padding facing a catching area;

a shell thumb portion including a thumb main shell and padding facing the catching area;

a webbed pocket extending between the shell finger portion and the shell thumb portion, the webbed pocket contiguous with the catching area;

a replaceable mitt including a mitt finger portion defining a plurality of finger stalls and a mitt thumb portion defining a thumb stall so that a user's hand can be placed within the replaceable mitt, with a plurality of the user's fingers located in the plurality of finger stalls and with the user's thumb located in the thumb stall, the mitt thumb portion joined with the mitt finger portion so that a distal end of the mitt finger portion is moveable toward the mitt thumb portion;

wherein the replaceable mitt is operable in an installed mode, in which the mitt finger portion is adjacent and detachably joined with the shell finger portion, and in which the mitt thumb portion is adjacent and detachably joined with the shell thumb portion, with the mitt finger portion and the mitt thumb portion being disposed on opposite sides of the webbed pocket, wherein the replaceable mitt is alternatively operable in a removed mode, in which the mitt finger portion and the mitt thumb portion are removed entirely from the shell finger portion and the shell thumb portion, and dissociated from the glove, wherein the finger main shell includes a finger main shell exterior opposite a finger main shell interior, the finger main shell interior forming at least a portion of the catching area, wherein the finger main shell exterior includes a hook and loop fastener system, wherein the mitt finger portion includes a mitt interior, wherein the mitt interior faces toward the finger main shell exterior, wherein the mitt interior includes a corresponding hook and loop fastener system, wherein the mitt interior is detachably joined to the finger main shell exterior via the interaction of the hook and loop fastener system and the corresponding hook and loop fastener system.

10. A goaltender glove comprising:

a shell finger portion including a finger main shell, a shell end portion, and padding facing a catching area;

a shell thumb portion including a thumb main shell and padding facing the catching area;

a webbed pocket extending between the shell finger portion and the shell thumb portion, the webbed pocket contiguous with the catching area;

a replaceable mitt including a mitt finger portion defining a plurality of finger stalls and a mitt thumb portion defining a thumb stall so that a user's hand can be placed within the replaceable mitt, with a plurality of the user's fingers located in the plurality of finger stalls and with the user's thumb located in the thumb stall, the mitt thumb portion joined with the mitt finger portion so that a distal end of the mitt finger portion is moveable toward the mitt thumb portion;

wherein the replaceable mitt is operable in an installed mode, in which the mitt finger portion is adjacent and detachably joined with the shell finger portion, and in which the mitt thumb portion is adjacent and detachably joined with the shell thumb portion, with the mitt finger portion and the mitt thumb portion being disposed on opposite sides of the webbed pocket, wherein the replaceable mitt is alternatively operable in a removed mode, in which the mitt finger portion and the mitt thumb portion are removed entirely from the shell finger portion and the shell thumb portion, and dissociated from the glove, wherein the thumb main shell includes a thumb main shell exterior opposite a thumb main shell interior, the thumb main shell interior forming at least a portion of the catching area, wherein the thumb main shell exterior includes a hook and loop fastener system, wherein the mitt thumb portion includes a mitt interior, wherein the mitt interior faces toward the thumb main shell exterior, wherein the mitt interior includes a corresponding hook and loop fastener system, wherein the mitt interior is detachably joined to the thumb main shell exterior via the interaction of the hook and loop fastener system and the corresponding hook and loop fastener system.

11. A goaltender glove comprising:

a main shell including a shell finger portion and a shell thumb portion joined with a webbed pocket spanning there between, the shell finger portion including a shell end portion, the main shell including an interior defining a catching area that extends into the webbed pocket, the shell finger portion and the shell thumb portion, the main shell joined with a backhand to form a cavity between an exterior of the main shell and an interior of the backhand;

a first mitt including a first mitt finger portion and a first mitt thumb portion, the first mitt disposed in the cavity, the first mitt including a distal end and defining a mitt interior;

a member including a first end and a second end, the first end of the member joined with the first mitt finger portion adjacent the distal end, the second end of the member joined with the shell end portion, wherein the member joins the distal end of the first mitt finger portion and the shell end portion, whereby the first mitt and a plurality of fingers disposed in the first mitt move together without the fingers slipping substantially relative to the interior of the first mitt as the glove transitions from a closed mode to an open mode, wherein the first mitt includes a palm portion between the finger portion and the thumb portion, the palm portion being selectively manually attachable and detachable from the main shell.

12. A goaltender glove comprising:

a main shell including a finger portion and a thumb portion joined together with a webbed pocket spanning there between, the main shell including an interior defining a catching area that extends into the webbed pocket, the main shell including a layer of padding facing the catching area, the main shell joined with a backhand to form a cavity between an exterior of the main shell and an interior of the backhand;

a first mitt including a first mitt finger portion and a first mitt thumb portion, the first mitt selectively disposed in the cavity;

a fastener joining the main shell and the mitt so that the first mitt is manually detachable from the main shell and removable from the cavity;

an elastic member extending between and joining the finger portion of the main shell and the first mitt finger portion to selectively urge a distal end of the first mitt finger portion toward an upper portion of the finger portion of the main shell when the glove is in a closed mode;

whereby a user can manually remove the first mitt from the cavity and the main shell without destroying the first mitt or the main shell, whereby a user can at least one of service the first mitt and replace the first mitt with a second mitt.

13. The goaltender glove of claim 12 wherein the first mitt finger portion defines a first plurality of stalls adapted to receive a plurality of fingers.

14. The goaltender glove of claim 12 comprising a finger flap joined with the main shell and foldable over the first mitt finger portion to secure the finger portion within the cavity in a preselected orientation.

15. The goaltender glove of claim 13 wherein the first plurality of finger stalls are offset from the first mitt thumb portion at a first angle.

16. The goaltender glove of claim 15 comprising a second mitt including a second mitt finger portion and a second mitt thumb portion, the second mitt finger portion defining a second plurality of stalls adapted to receive the plurality of fingers, wherein the second plurality of finger stalls are offset from the second mitt thumb portion at a second angle different from the first angle, whereby the second angle provides a different feel of the glove upon closure thereof relative to the first angle.

17. A goaltender glove comprising:

a main shell including a finger portion and a thumb portion joined with a webbed pocket spanning there between, the finger portion including a shell end portion, the main shell including an interior defining a catching area that extends into the webbed pocket, the finger portion and the thumb portion, the main shell joined with a backhand to form a cavity between an exterior of the main shell and an interior of the backhand;

a first mitt including a first mitt finger portion and a first mitt thumb portion, the first mitt disposed in the cavity, the first mitt including a distal end and defining a mitt interior;

a member including a first end and a second end, the first end of the member joined with the first mitt finger portion adjacent the distal end, the second end of the member joined with the shell end portion, wherein the member joins the distal end of the first mitt finger portion and the shell end portion, wherein the member is an elastic member, and the second end of the member includes a fastener, wherein the shell end portion includes a corresponding fastener that is selectively manually attachable and detachable from the fastener, wherein the first mitt finger portion is coupled to the shell end portion so that the first mitt finger portion is selectively urged toward the shell end portion, whereby the first mitt and a plurality of fingers disposed in the first mitt move together without the fingers slipping substantially relative to the interior of the first mitt as the glove transitions from a closed mode to an open mode.

18. A goaltender glove comprising:

a main shell including a finger portion and a thumb portion joined with a webbed pocket spanning there between, the finger portion including a shell end portion, the main shell including an interior defining a catching area that extends into the webbed pocket, the finger portion and the thumb portion, the main shell joined with a backhand to form a cavity between an exterior of the main shell and an interior of the backhand;

a first mitt including a first mitt finger portion and a first mitt thumb portion, the first mitt disposed in the cavity, the first mitt including a distal end and defining a mitt interior;

a member including a first end and a second end, the first end of the member joined with the first mitt finger portion adjacent the distal end, the second end of the member joined with the shell end portion, wherein the member joins the distal end of the first mitt finger portion and the shell end portion, wherein the first mitt includes a palm portion between the finger portion and the thumb portion, the palm portion being selectively manually attachable and detachable from the main shell.

* * * * *